United States Patent [19]

Auerbach

[11] Patent Number: 4,643,123

[45] Date of Patent: Feb. 17, 1987

[54] ENVELOPE MOISTENING APPARATUS

[75] Inventor: David R. Auerbach, Georgetown, Conn.

[73] Assignee: Pitney Bowes Inc., Stamford, Conn.

[21] Appl. No.: 797,744

[22] Filed: Nov. 8, 1985

Related U.S. Application Data

[63] Continuation of Ser. No. 324,192, Nov. 23, 1981, abandoned.

[51] Int. Cl.[4] ..... B05C 1/02

[52] U.S. Cl. ..... 118/32; 118/268; 156/441.5

[58] Field of Search ..... 118/32, 264, 268; 156/441.5, 442, 442.1, 442.2, 442.3; 16/223, 380, 385, 267, DIG. 13; 49/397, 220/338

[56] References Cited

U.S. PATENT DOCUMENTS

| | | | |
|---|---|---|---|
| 2,674,975 | 4/1954 | Krueger | 118/264 X |
| 2,765,094 | 10/1956 | Ryan | 220/338 |
| 2,944,511 | 7/1960 | Bach et al. | 156/442.1 X |
| 3,113,692 | 12/1963 | Di Pierro | 220/338 |

*Primary Examiner*—Evan K. Lawrence

*Attorney, Agent, or Firm*—Donald P. Walker; David E. Pitchenik; Melvin J. Scolnick

[57] ABSTRACT

Envelope flap moistening apparatus for use in a machine for feeding an envelope having a flap in a predetermined path of travel. The apparatus includes a hinge pin which is connected to the machine so as to extend across the path of travel of an envelope flap. In addition, the apparatus includes an elongate brush for applying moisture to an envelope flap, which brush includes a base. The apparatus also includes an elongate brush retainer which is made of a resilient plastic material. The brush retainer includes first and second channels. The first channel is dimensioned for engagement with the hinge pin and has an elongate opening dimensioned for receiving the hinge pin through the opening for attaching the retainer to the hinge pin. And the second channel, having a generally inverted-U-shaped transverse cross-section, is dimensioned for insertion and removal of the brush base against resilient forces exerted on the base by the walls of the second channel for attaching the brush to the retainer.

5 Claims, 7 Drawing Figures

ENVELOPE MOISTENING APPARATUS

This application is a continuation of application Ser. No. 324,192, filed Nov. 23, 1981, now abandoned.

BACKGROUND OF THE INVENTION

It is known in the art to provide envelope flap separating and moistening apparatus for use in postage metering systems, wherein the apparatus comprises three integrally cooperative parts. For example, as disclosed in U.S. Pat. No. 3,859,955 issued Jan. 14, 1975 to Labore and assigned to the assignee of the present invention, there is disclosed moistening apparatus which includes a plastic molded flap separator, a moistening pad and a plastic molded retainer for holding the moistening pad; wherein the flap separator and pad retainer are cooperatively configured for engaging and disengaging each from the other, and the retainer is configured to receive and grip the pad and to permit its slidable removal from the retainer.

In the aforesaid moistening apparatus the pad retainer includes a system of flexible protrusions or spikes, two of which snap into holes in the flap separating member for engagement of the separating member, and three of which hookably engage the moistening pad when the pad is inserted into the retainer. For cleaning purposes, the moistening apparatus is initially disassembled by removing the pad retainer from the separating member. To do so, a pointed instrument such as a pencil must be inserted into the holes of the separating member for depressing and thereby releasing the retainer spikes from engagement with the separating member. Usually, the pad cannot be throughly cleaned unless it is removed from the retainer, and, the only way to do so without shredding or otherwise damaging the pad is to carefully, slidably disengage the pad from the retainer. If the pad is otherwise removed, the retainer spikes associated with the pad tend to dig into rather than release the pad, as a consequence of which further attempted removal damages the pad to the extent that it must be replaced.

With the aforesaid arrangement of moistening apparatus, although customers may be instructed in the proper procedure for disassembly for cleaning purposes, they tend to either avoid doing so, or improperly do so, as a result of which numerous service calls are made.

In addition to the foregoing it has been found that liquid applicators such as the urethane pad used in the aforesaid apparatus have a relatively short service life as compared to brushes. And, due to the need to provide the retainers with spikes, different injection molds must be provided to accommodate different sizes of retainers. Accordingly:

An object of the invention is to provide customer serviceable flap moistening apparatus;

Another object is to provide flap moistening apparatus including a retainer which is both mountable on, and demountable from, a flap separator without the use of tools;

Another object is to provide moistening apparatus including a liquid applicator which is attachable to, and detachable from, the aforesaid retainer without damaging the applicator or retainer; and Another object is to provide flap moistening apparatus which may be mass produced for different applications requiring differently dimensioned moistening apparatus without the need for providing different mold sizes.

SUMMARY OF THE INVENTION

Envelope flap moistening apparatus for use in a machine for feeding an envelope having a flap in a predetermined path of travel. The apparatus includes a hinge pin which is connected to the machine so as to extend across the path of travel of an envelope flap. In addition, the apparatus includes an elongate brush for applying moisture to an envelope flap, which brush includes a base. The apparatus also includes an elongate brush retainer which is made of a resilient plastic material. The brush retainer includes first and second channels. The first channel is dimensioned for engagement with the hinge pin and has an elongate opening dimensioned for receiving the hinge pin through the opening for attaching the retainer and hinge pin to each other. And the second channel is dimensioned for insertion of the brush base into the second channel against the resilient forces exerted on the base by the walls of the second channel for attaching the brush to the retainer.

BRIEF DESCRIPTION OF THE DRAWINGS

As shown in the drawings wherein like reference numerals designate like or corresponding parts throughout the several views.

DESCRIPTION OF THE PREFERRED EMBODIMENT

Figure 1:
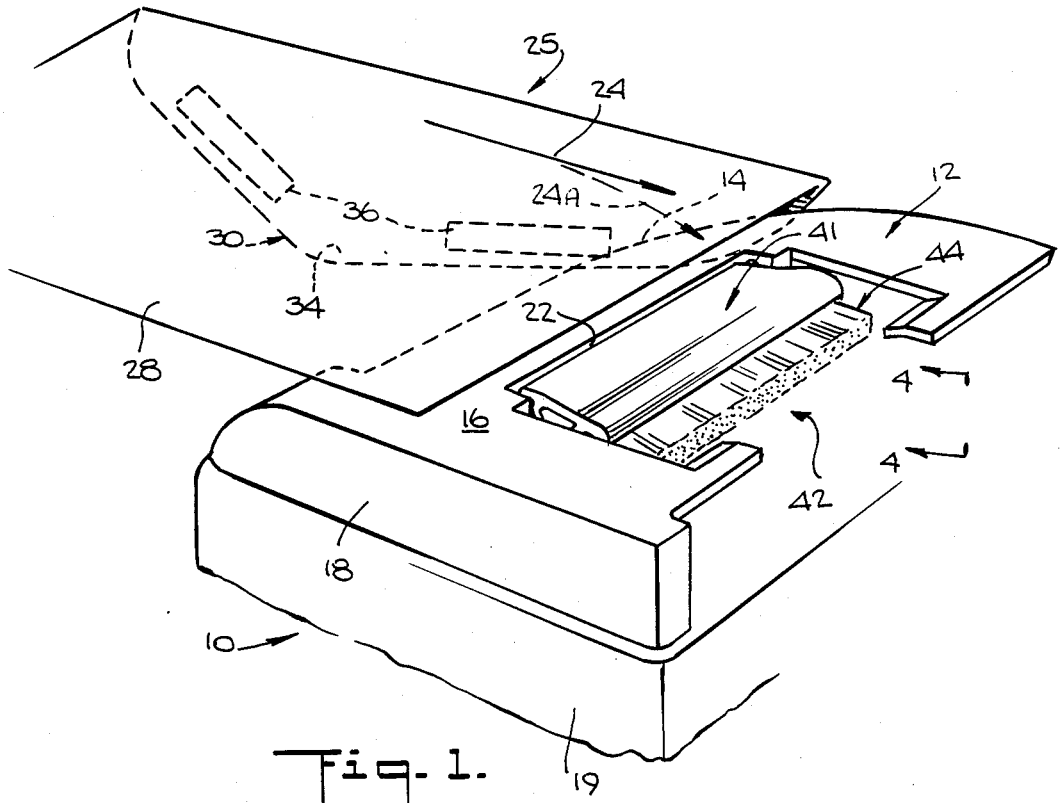
FIG. 1 is a fragmentary perspective view of an envelope feeding machine, including flap moistening apparatus according to the invention.
Figure 2:
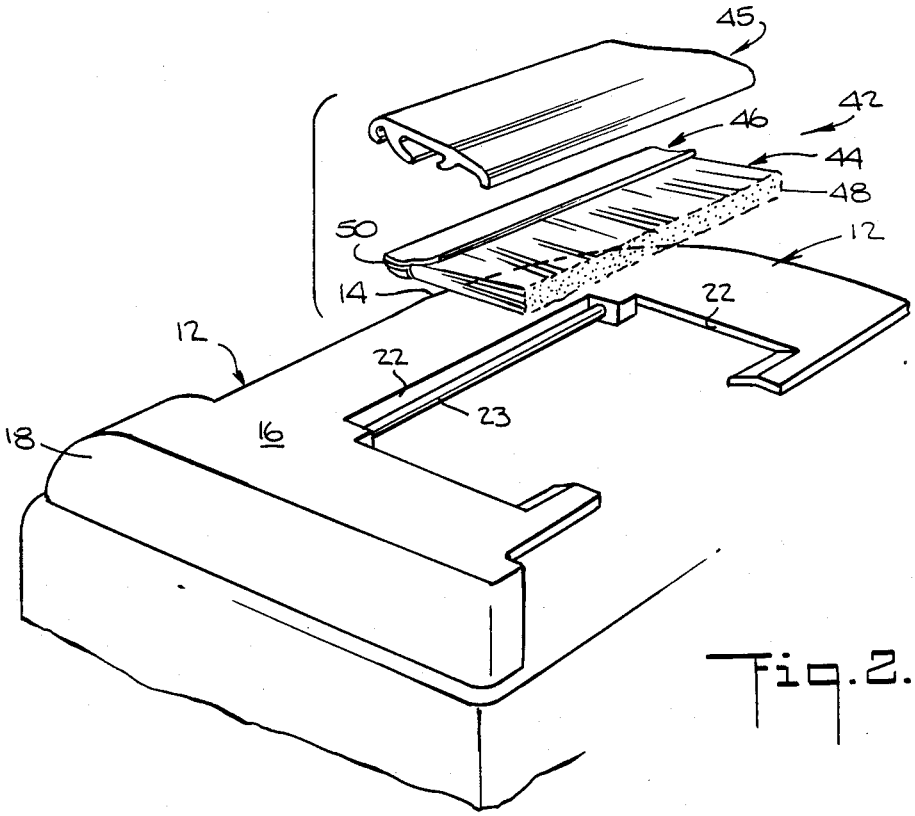
FIG. 2 is a fragmentary exploded view of the apparatus of FIG. 1.

An envelope feeding machine 10 (FIG. 1) of the type which may be modified in accordance with the present invention, generally comprises envelope flap separating structure including a plate-like, flap stripper member 12, having a knife-like leading edge 14 and an upper surface 16. In addition, the machine 10 includes a skirt wall 18 which depends from the stripper member 12 for conventionally attaching the stripper member 12 to the casing 19 of the machine 10. The stripper member 12, which has a genera11y rectangularly-shaped opening 22 formed therein, includes a hinge pin 23 (FIG. 2) which is conventionally connected to the stripper member 12 within the opening 22 so as to extend across a predetermined path of travel 24 of the envelopes 25. The machine 10 serially feeds respective envelopes 25, each of which has a body portion 28 and a flap 30, in the predetermined path of travel 24 until the flap 30 engages the leading edge 14 of the stripper member 12. Whereupon the body portion 28 of the envelope passes over the stripper member's upper surface 16 and the flap 30 is diverted downwardly, in the direction of the arrow 24A beneath the flap stripper member 14. As the flap 30 is lowered out of its overlapping relationship with respect to the envelope's body portion 28, the flap's interior surface 34 is upwardly oriented, as is the liquid soluable adhesive substance 36 bonded to the surface 34. For moistening fluid supply purposes, the envelope feeding device 10 additionally includes a conventional source of supply 38 (FIG. 4) of moistening fluid 40.

According to the invention there is provided flap moistening apparatus 42 (FIG. 2), which is adapted to be removably mounted on the hinge pin 23, including a fluid applicator 44 and an applicator retainer 45.

Figure 4:
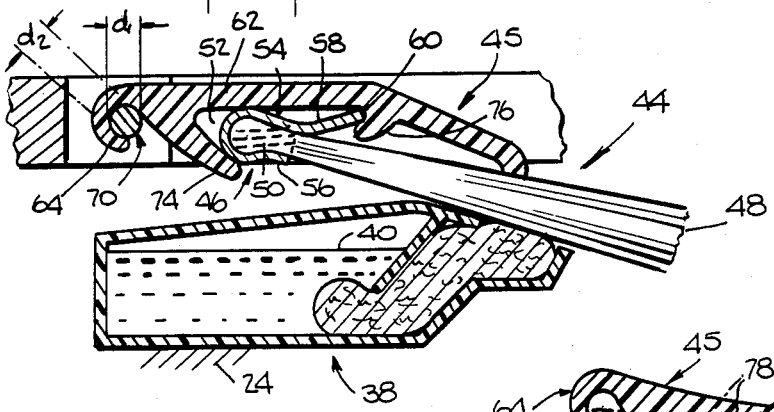
FIG. 4 is an enlarged, fragmentary, sectional view, taken substantially along the lines 4—4 of FIG. 1, showing a manner of engagement of the flap separator, retainer and applicator.

The fluid applicator 44 (FIG. 2), is preferably an elongate brush which includes a base portion 46, or ferrule, and a plurality of relatively short brush bristles 48. The base portion 46 is preferably made of a stiff, non-corrosive, elongate piece of sheet metal, such as brass sheet material, which is lengthwise clamped against marginal ends of the brush bristles 48 so as to securely hold the bristles 48 in place, and is additionally pinched at the opposed ends so as to form pointed ends 50. As shown in FIG. 4, the base 46 is generally C-shaped in a transverse cross-section, having a curvedly-extending forward end 52 and converging upper and lower side walls, respectively designated 54 and 56. The upper side wall 54 additionally includes a rearwardly-extending wall portion 58 having a longitudinally extending end edge 60.

Figure 3:
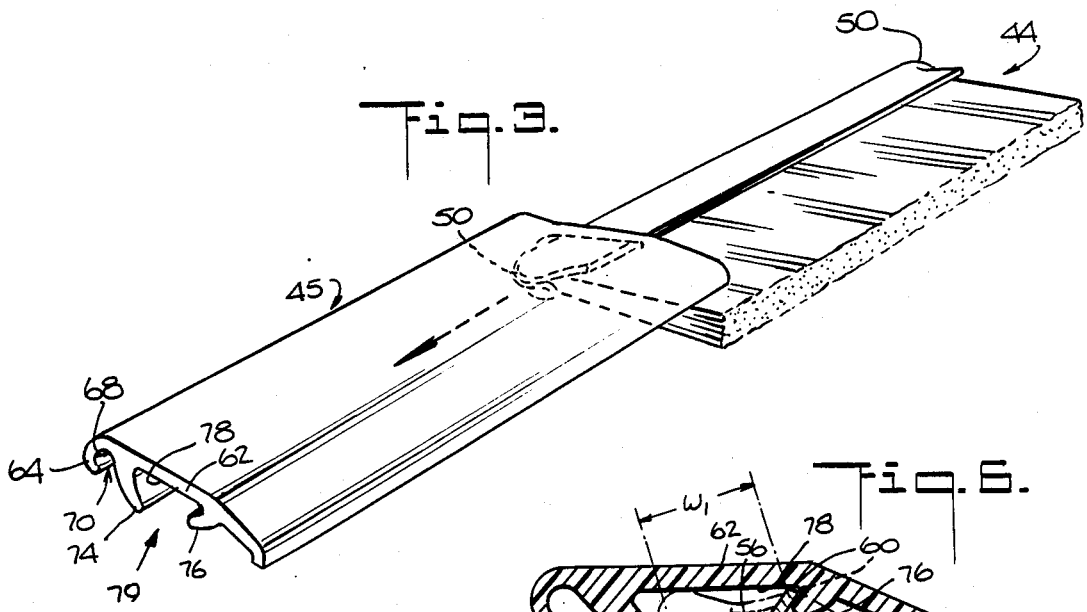
FIG. 3 is an enlarged fragmentary view of FIG. 1, showing the retainer and applicator relatively oriented for slidable engagement.

The applicator retainer 45 (FIG. 4) is preferably made of an extrudable, resilient, plastic material, such as polypropylene or polystyrene, or the like. The retainer 45 includes an upper wall portion 62, and a depending C-shaped wall portion 64. The depending C-shaped wall portion 64 defines a longitudinally-extending, first, open-ended, channel 68 (FIG. 3) having a longitudinally extending opening 70 into the channel 68. The opening 70 preferably has a transverse dimension "d1" (FIG. 4) which is less than the diameter "d2" of the hinge pin 23, for facilitating attaching the retainer 45 to, and detaching the retainer 45 from, the hinge pin 23 via the opening 70, by relatively urging the hinge pin 23 through the opening 70 against the resilient force exerted by the depending wall portion 64 on the hinge pin 23. Preferably, the circularly-shaped interior of the wall portion of the first channel 68 is dimensioned such that it is large enough to permit rotation of the retainer 45 on the hinge pin 23 to avoid binding in the event that the hinge pin 23 is fixedly attached to the stripper member 12 (FIG. 2) in the course of fabrication, or the hinge pin 23 becomes bound for any reason subsequent to fabrication.

Figure 6:
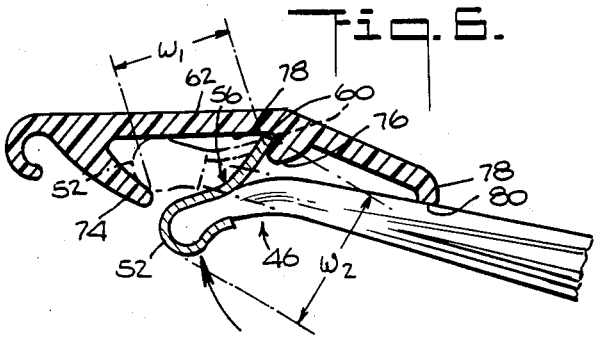
FIG. 6 is a fragmentary, partially phantom, view of the FIG. 4, showing the applicator being attached to the retainer.

The retainer 45 (FIG. 3), also includes a depending, rearwardly-extending, finger-shaped wall portion 74, which is spaced rearwardly of the wall portion 64, and a depending, forwardly-extending, finger-shaped wall portion 76, which is spaced rearwardly of the wall portion 74. The depending wall portions, 74 and 76, and the upper wall portion 62 conjointly define a longitudinally-extending, inverted U-shaped, open-ended, second channel 78. Further, the opposed converging wall portions, 74 and 76, are dimensioned to define a longitudinally-extending opening 79 into the second channel 78. The opening 79 has a width "$W_1$" (FIG. 6) which is less than the width "$W_2$" of the upper side wall 54 of the brush base 46 as measured from the forward end 52 of the brush base 46 to the end 60 of the upper wall 54. In addition, second channel 78 is preferably dimensioned for insertion of the brush base 46 within, and removal from, the second channel 78 against the resilient force exerted on the brush base 46 by the channel wall portions 74 and 76. For example, for inserting the brush base 46 (FIG. 3) into the second channel 78, either of the pointed ends 50 of the brush base 46 may be initially inserted into either of the open ends of the second channel 78, whereupon the brush base 46 and retainer 45 may be slidably urged into engagement with each other against the resilient force exerted on the brush base 46 by the wall portions 74 and 76. Alternatively, the brush 44 and retainer 45 may be assembled by sidewise aligning the second channel 78 and brush base 46 with each other, inserting the rearwardly extending portion 58 of the brush base 46 into the channel 78, so that the end 60 of wall portion 58 is disposed adjacent to the depending wall portion 76, and then sidewise urging the forward end 52 of the brush base 46 into the second channel 78 against the resilient force exerted on the brush base 46 by the depending wall portion 74. When the brush base 46 is inserted into the second channel 78, the wall portions 74 and 76 resiliently grasp the inserted brush base 46 for holding the brush 44 in place. In addition, the upper wall 62 of the retainer 45 gradually depends downwardly and rearwardly from the rear wall portion 76 so as to define a longitudinally-extending trailing end 79, having a downwardly facing marginal edge 80, for urging the brush bristles 48 into the path of travel 24A and thus into engagement with respective envelope flaps 30 fed beneath the brush bristles 48.

Figure 7:
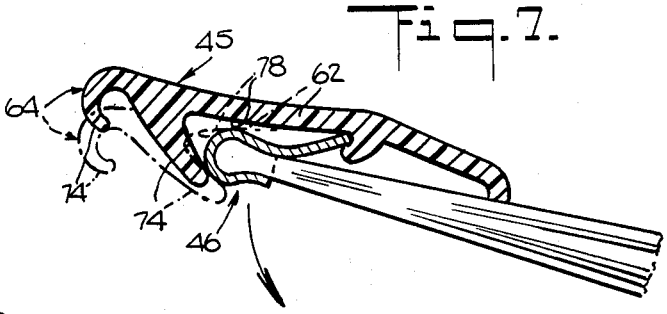
FIG. 7 is a view similiar to FIG. 6, showing the retainer being detached from the applicator.
Figure 5:
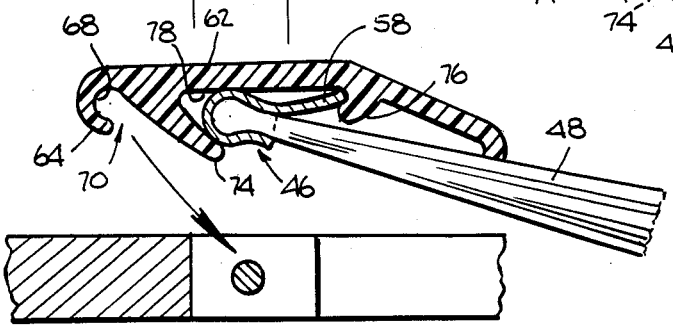
FIG. 5 is a partially exploded view of FIG. 4 showing the retainer being mounted on the flap separator.

For removing the brush 44 (FIG. 4) from the retainer 45, the brush base 46 may be slidably removed from the second channel 78 by reversing the procedure hereinbefore described, except that, for ease of removal, the brush bristles 48 may be grasped for brush removal purposes. In addition, as an alternative to slidably removing the brush 44 from the second channel 78, the brush 44 may be removed by raising the depending C-shaped wall portion 64 (FIG. 7) of the retainer 45 out of engagement with brush base 46 against the resilient force exerted on the brush base 46 by the depending wall portion 74.

In accordance with the objects of the invention there has been described an improvement in flap moistening apparatus for use in a machine for feeding an envelope having a flap, wherein the flap moistening apparatus may be attached to, and detached from, the envelope feeding apparatus by customers without the use of tools, and wherein customers may additionally assemble and disassemble the detached flap moistening apparatus without the use of tools and without danger of damage to the apparatus. Further, the improved apparatus may be manufactured without using different mold sizes due to the provision of an extruded retainer.

Inasmuch as certain changes may be made in the above described invention without departing from the spirit and scope of the same, it is intended that all matter container in the above description or shown in the accompaning drawings shall be interpreted in an illustrative rather than limiting sense. And, it is intended that the following claims be interpreted to cover all the generic and specific features of the invention herein described.

What is claimed is:

1. Envelope flap moistening apparatus for use in a machine for feeding an envelope having a flap in a predetermined path of travel, the apparatus comprising:

(a) a hinge pin connected to the machine so as to extend across the path of travel of an envelope flap;

(b) an elongate brush for applying moisture to an envelope flap, the brush including an elongate base;

(c) an elongate brush retainer cut from an extruded length of resilient plastic material, the brush retainer including an elongate upper wall portion, the retainer including an elongate first wall portion depending from the upper wall portion and defining a first open-ended channel, the first channel having a C-shaped transverse cross-section and being dimensioned for engagement with the hinge pin, the first channel having a longitudinally-extending opening thereinto which is dimensioned for receiving the hinge pin therethrough and into the first channel against the resilient force exerted on the hinge pin by the retainer for attaching the retainer and hinge pin to each other, said retainer and hinge pin being detachable from: each other against the resilient force exerted on the hinge pin by the retainer, the brush retainer including second and third elongated opposing wall portions depending from the upper wall portion and defining a second open-ended channel having a generally inverted-U-shaped transverse cross-section, the second and third wall portions converging to define a longitudinally-extending opening into the second channel, the second channel opening dimensioned for insertion of the brush base into the channel against the resilient force exerted on the brush base by the second and third wall portions of the retainer for attaching the brush to the retainer, and the retainer and brush being detachable from each other against the resilient force exerted on the brush base by the second and third wall portions of the retainer.

2. The apparatus according to claim 1, wherein the brush includes bristles attached to the base, and the retainer includes a wall portion for urging the brush bristles into engagement with an envelope flap.

3. The apparatus according to claim 1, wherein the brush base includes a pointed end, the pointed end of the brush base being dimensioned for insertion into the open end of the second channel for slidably engaging the brush base and retainer.

4. The apparatus according to claim 1, wherein the brush base is made of a non-corrosive material and includes a pointed end.

5. The apparatus according to claim 1, wherein the brush base includes oppositely pointed end, and either of the brush base pointed ends are respectively insertable into either of the open ends of the second channel for slidably engaging the brush base and retainer.

* * * * *